United States Patent [19]

Hunt

[11] 4,201,005

[45] May 6, 1980

[54] EMERGENCY ILLUMINATION APPARATUS

[76] Inventor: James A. Hunt, 19 Frost La., Marblehead, Mass. 01945

[21] Appl. No.: 903,086

[22] Filed: May 5, 1978

[51] Int. Cl.[2] ..... G09F 13/04

[52] U.S. Cl. ..... 40/570; 40/573; 40/578; 362/267; 362/812

[58] Field of Search ..... 40/570, 573, 578; 362/812, 267

[56] References Cited

U.S. PATENT DOCUMENTS

| | | | |
|---|---|---|---|
| 2,316,835 | 4/1943 | Blood | 362/267 X |
| 2,535,799 | 12/1950 | Kelley et al. | 362/267 X |
| 2,702,849 | 2/1955 | Bissell | 362/267 |
| 2,793,356 | 5/1957 | Hart | 40/573 X |
| 3,916,404 | 10/1975 | Gouge | 40/570 X |
| 4,054,792 | 10/1977 | Brudy | 362/267 |
| 4,069,415 | 1/1978 | Dacal | 362/267 X |

*Primary Examiner*—John F. Pitrelli
*Assistant Examiner*—G. Lee Skillington
*Attorney, Agent, or Firm*—David Silverstein

[57] ABSTRACT

The invention is an emergency illumination apparatus for use in areas where the presence of gases, vapors, dust, or combustible matter makes the use of conventional apparatus hazardous. The apparatus has a front compartment and a rear, explosion proof compartment that is separated, from the front apartment, by a divider wall. This divider wall has sealed light sockets on the front compartment side. Furthermore, the rear compartment has sealed electrical connections to at least two independent power sources.

18 Claims, 1 Drawing Figure

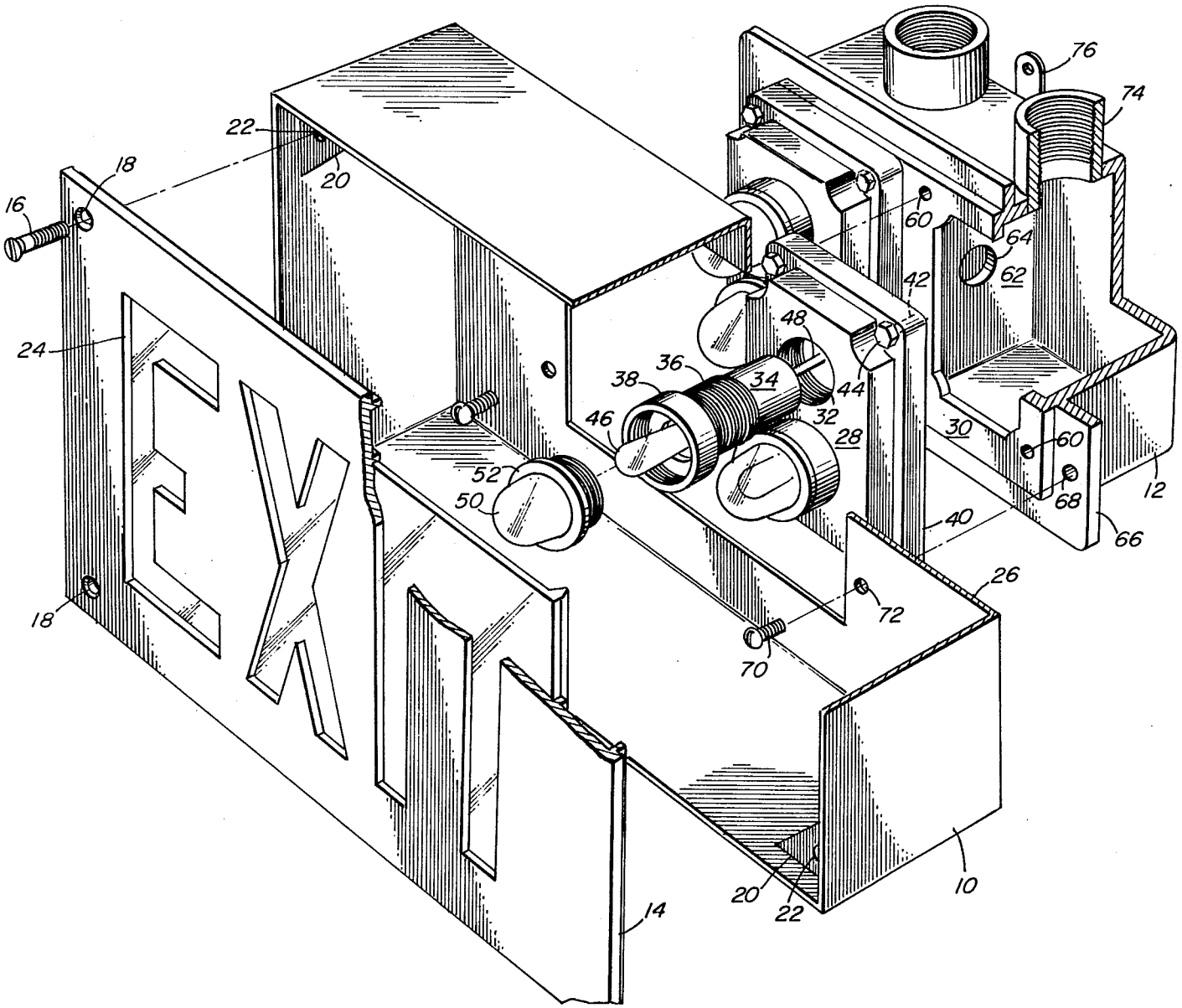
12
66
74
76
60
68
64
62
26
10
30
40
60
42
72
44
28
32
48
34
70
22
20
36
14
38
46
52
50
20
22
18
24
16
18 compartment 10 and a rear compartment 12. Forward compartment 10 is not an explosion-proof chamber and, therefore, may be constructed of any conventional, generally light-weight materials such as aluminum or aluminum alloys or sheet metal.

The forward face 14 is provided such that it can be readily secured to or readily removed from the front compartment 10. In FIG. 1, these means consist of four threaded bolts 16 (one is shown), four corner holes 18 in forward face 14 (two are shown), and four angular inserts 20 (two are shown) attached to the corners of forward compartment 10 with holes 22 aligned with holes 18 respectively and designed to receive bolts 16. Alternatively, hinge or other equivalent means of readily opening forward face 14 to gain access to the interior of compartment 10 may be used. As shown in FIG. 1, forward face 14 consists of a translucent sheet of glass or plastic covered by a metal frame with lettering areas 24 stamped or cut out to spell "EXIT" or some other emergency information. The metal frame may be fashioned from aluminum or light-weight aluminum alloys. Alternatively, forward face 14 may consist simply of a sheet of substantially opaque glass or plastic with translucent lettering areas 24. For example, a translucent sheet of glass or plastic of suitable size can be stenciled with the desired lettering and then painted or otherwise darkened over the non-lettering areas. The sheet of glass or plastic need not be perfectly opaque apart from the lettering areas, but only sufficiently darker than the lettering areas to provide a good contrast. Of course, the emergency message may also appear by means of symbols or in languages other than English, for example "SORTI" in French.

The rear face 26 of compartment 10 is partially cut away so as to accommodate two lighting fixtures 28 forwardly protruding from the forward face 30 of compartment 12. Rear face 26 of compartment 10, forward face 30 of compartment 12 and the lighting fixtures 28 together constitute a divider wall between the two compartments. Each lighting fixture 28 consists of a generally rectangular metal base having two centrally-located holes 32 internally threaded so as to accommodate two explosion-proof light sockets 34. The metal base may be constructed from any strong, light-weight and highly heat-conductive metal such as aluminum and aluminum alloys. The thickness of the metal base may vary from about ¼" to 1" or more depending on the nature of the hazardous atmosphere in which the apparatus is to be used. Each lighting fixture 28 also includes an outer flange 40 around the rear edge of the metal base with four threaded corner holes 42 designed to accommodate threaded bolts 44 (two shown) for securing the lighting fixtures to the forward face 30 of compartment 12 by means of threaded holes 60 (two shown).

Each explosion-proof light socket 34 consists of an elongated, externally-threaded barrel 36 and internally-threaded flange 38. The forward end of barrel 36 is internally threaded to accommodate light bulb 46 in a standard light socket which is electrically connected to a power source by means of wire 48 extending from the rear of barrel 36. The interior of the rear portion of barrel 36 surrounding wire 48 is sealed air-tight with a conventional sealing compound designed to withstand high pressures.

Light bulb 46 is sealed in an explosion-proof chamber by means of cap 50, made of heavy-duty shatter-proof glass and having an outward lip, and metal casing 52 which is designed to fit snugly over the glass lip and is externally threaded to engage flange 38. As previously noted, the "explosion-proof" chamber which is thus created when cap 50 is secured over light bulb 46 is not a gas-tight chamber. Rather, in the event that a hazardous atmosphere should enter the chamber and be ignited either by the heat or a spark from light bulb 46, the hot explosion gases would be contained within the chamber and could escape only by passing along the precision threads joining flange 38 and casing 52 or else along the precision threads joining the threaded barrel 36 to the hole 32 in the metal base of fixture 28. In designing the precision-threaded metallic elements of this apparatus, it is important that the threaded paths be sufficiently long and the metal be sufficiently conductive that by the time the explosion gases have reached the outside atmosphere, they have been cooled by conduction to below the ignition temperature of the surrounding hazardous atmosphere.

Compartment 12 is an explosion-proof chamber where all internal electrical connections are made. It is the only place in this apparatus, apart from the light bulb chamber previously discussed, where there is any likelihood of an explosion occurring. Accordingly, although compartment 12 can be made from the same light weight, highly heat-conductive aluminum and aluminum alloys as compartment 10, it is shown in FIG. 1 as being of a more heavy-duty construction. The interior of compartment 12 is generally empty except for the wires and electrical connectors leading to the lighting fixtures 28. In some cases, however, it is desirable to partition compartment 12 into two chambers by means of dividing wall 62 with hole 64 for making electrical connections between the two chambers.

The forward face 30 of compartment 12 is partially cut away in two generally rectangular openings to accommodate the two lighting fixtures 28. As previously discussed, the lighting fixtures are attached to forward face 30 by means of threaded bolts 44 extending through holes 42 in flanges 40 and holes 60 in forward face 30. The rear portion of flanges 40 and the forward face 30 are precision ground so as to fit together securely. Although the resulting connection is not gas-tight, any hot explosion gases escaping from the interior of compartment 12 through this metal-metal juncture would be cooled by conduction before reaching the surrounding hazardous atmosphere. Forward face 30 of compartment 12 also includes flanges 66 with four holes 68 (one shown) for securing compartment 12 to compartment 10. This is done by means of threaded bolts 70 passing through holes 72 in the rear face of compartment 10 and through holes 68 in flange 66 of compartment 12.

Insulated electrical wiring enters the interior of compartment 12 through one or two internally-threaded flanges 74. The wiring is enclosed in sealed metal barrels (not shown) with precision external threading designed to engage flanges 74 in a manner similar to barrel 36 engaging threaded hole 32 in light socket 34 as shown in FIG. 1. Thus, in the event that a hazardous atmosphere should enter compartment 12 and be ignited by a spark from the electrical connections, the hot explosion gases would be contained within compartment 12 and could escape only by passing along the precision threads of flanges 74 or the precision threads joining barrel 36 and hole 32, or else passing between the precision ground surfaces of flange 40 and forward face 30. In any of these instances, the path lengths are designed

EMERGENCY ILLUMINATION APPARATUS

BACKGROUND OF THE INVENTION

Emergency illumination is designed to supply illumination and power in the event of the failure of normal supply or, in the event of accidents, to insure uninterrupted illumination where it is essential for safety to life and property. The most familiar examples are the "Exit" signs normally required in places of public assembly such as hotels, theaters, sports arenas, hospitals, office buildings, and industrial plants.

The National Electrical Code establishes certain standards for emergency illumination; and, in many if not most municipalities and states, identical or equivalent standards have been established by law. Among many other requirements, the National Electrical Code requires: (1) that emergency lighting systems be designed and installed so that the burning out of any individual lighting element cannot leave any space in total darkness; and, (2) that two or more separate and complete systems with independent power supply, each providing sufficient current for emergency lighting purposes, be supplied.

There are numerous patents related to emergency illumination apparatus - for example, U.S. Pat. Nos. 1,148,341; 1,469,946; 1,809,243; 1,875,520; 1,887,523; 2,372,124; 3,136,083; 3,309,806; 3,324,290; 3,402,494; 3,478,455; 3,587,186; 3,665,626; and 3,780,462. However, only a couple of the more recent of these patents, such as U.S. Pat. Nos. 3,916,404 and 3,931,689, either meet or could readily be adapted to meet the National Electrical Code requirements.

Hazardous atmosphere locations are locations in which the continuous or periodic presence of certain gases, vapors, dust or combustible particles creates a danger of explosion upon exposure to sparks or temperatures in excess of the ignition temperature. The National Electrical Code establishes three classes of hazardous locations: Class I locations are those in which flammable gases or vapors are or may be present in the air in quantities sufficient to produce explosive or ignitible mixtures; Class II locations are those that are hazardous because of the presence of combustible dust; Class III locations are those that are hazardous because of the presence of easily ignitible fibers or flyings, but in which such fibers or flyings are not likely to be in suspension in the air in quantities sufficient to produce ignitible mixtures.

The National Electrical Code further subdivides each of the three classes into two divisions depending upon the relative likelihood of the ignitible material being generally dispersed in the air. For example, Class I, Division 1 are those in which hazardous concentrations of flammable gases or vapors exist continuously, intermittently, or periodically under normal operating conditions. Class I, Division 2 are those in which volatile flammable liquids or flammable gases are handled, processed, or used, but in which the hazardous liquids, vapors, or gases will normally be confined within closed containers or closed systems. Although the present invention is particularly suitable for Class I, Division 1 locations, it may be advantageously employed in any hazardous atmosphere locations.

In addition, the National Electrical Code establishes four subclasses for Class I locations, Groups A-D, and three for Class II locations, Groups E-G, depending on the ignition temperature of the hazardous substances:

Class I. Group A—280° C. (536° F.); Group B—280° C. (536° F.); Group C—180° C. (356° F.); Group D—280° C. (536° F.); and, Class II. Group E—200° C. (392° F.); Group F—200° C. (392° F.); and Group G—165° C. (329° F.). Although the present invention is particularly suitable for Class I, Groups C and D, and Class II, Groups E, F and G locations, with minor modifications as hereinafter described, this invention can be readily adapted for use under other hazardous atmosphere conditions.

The principal requirement for explosion-proof electrical apparatus operating in hazardous atmosphere locations is not that it be gas-tight but rather that the enclosure in which a spark might occur be: (1) strong enough to contain an explosion and prevent the escape of any flame; and, (2) designed so as to diffuse and dissipate any heat which could ignite the surrounding atmosphere. With regard to electrical lighting units designed for operation in hazardous atmosphere locations, these requirements are typically met by providing a light bulb surrounded by an explosion-resistant glass casing with venting for hot gases in such a manner as to prevent any flames from reaching the surrounding atmosphere.

Such designs are described, for example, in U.S. Pat. Nos. 2,574,882; 2,652,482; 2,702,849; 2,749,433; 2,770,715; 2,786,936; 2,849,597; 3,675,007; and 3,723,724. Each of these devices, however, is directed to a single lighting fixture employing a single wiring design. None of these devices, even those which might meet the hazardous location requirements of the National Electrical Code, can also meet the emergency illumination requirements of the Code. There are many instances, however, in which emergency illumination is required or at least desirable for hazardous atmosphere locations, but none of the prior art devices are capable of satisfying both sets of criteria.

OBJECTS OF THE INVENTION

Accordingly, it is the primary object of this invention to provide an apparatus for emergency illumination in hazardous locations which fulfills all of the standards established by the National Electrical Code.

It is also an object of this invention to provide a small, compact and readily-transportable apparatus for emergency illumination in hazardous locations.

Still another object of this invention is to provide an apparatus for emergency illumination comprising at least two individual lighting elements operating on each of at least two independent power circuits and so designed that all electrical connections are made inside an explosion-proof chamber.

A further object of this invention is to provide an apparatus for emergency illumination in hazardous atmosphere locations in which the lighting elements are readily-accessible for easy replacement.

These and other objects and advantages of this invention will become apparent from the following description.

BRIEF DESCRIPTION OF THE DRAWING

FIG. 1 shows a partially cut-away perspective view of the emergency illumination apparatus of this invention.

DETAILED DESCRIPTION OF THE DRAWING

The emergency illumination apparatus of this invention consists of housing means comprising a forward to be sufficiently long and the metal parts sufficiently heat conductive so that the hot explosion gases are cooled to below the ignition temperature of the surrounding hazardous atmosphere before they are vented.

Because of differences in the ignition temperatures of different types of hazardous atmospheres, as previously described, and because of differences in the amount of heat released by the ignition of different types of hazardous materials, it may be necessary to adjust the construction parameters of the various parts of this apparatus to suit particular cases. For example, because acetylene, which is in Class I, Group A, generates a relatively large amount of heat per unit volume upon ignition, a larger amount of threading (i.e., a longer thread path) may be required to insure adequate cooling of the hot explosion gases.

The emergency illumination apparatus as herein described is small, compact, light-weight and readily transportable. It may be supported in the desired location, such as above a door, by any convenient means, for example by means of a mounting flange 76, as shown in FIG. 1, consisting simply of a metal tab with a hole for a nail, screw or hook.

The emergency illumination apparatus as herein described meets all of the National Electrical Code requirements with respect to hazardous atmosphere locations as well as emergency illumination. As previously described, the requirements with respect to hazardous atmosphere locations are met by providing "explosion-proof" chambers for the only two places in the apparatus where sparks or heat might ignite the hazardous atmosphere. By means of precision-threaded components and a novel design, any hot explosion gases which might be generated inside one of the explosion-proof chambers would be cooled to below the ignition temperature of the surrounding atmosphere before venting.

The emergency illumination requirements are met by providing two lighting fixtures 28, each containing two lighting elements 46. The two lighting elements for each lighting fixture are wired in parallel so that one bulb will continue burning even if the other bulb burns out. Furthermore, each lighting fixture has an independent power source; for example, one can be wired to a standard alternating current source and the other to an emergency direct current source such as a battery or an emergency generator. The apparatus of this invention can readily be modified to accommodate more than two lighting fixtures and more than two light bulbs on each lighting fixture, but the apparatus shown in FIG. 1 is sufficient to meet all of the National Electrical Code requirements.

Furthermore, in the event that one of the light bulbs burns out under ordinary operating conditions, the apparatus of this invention permits the light bulb to be readily replaced. The apparatus is simply disconnected from the power source, the forward face of the forward compartment is removed, the glass cover cap is unscrewed, the burnt-out bulb is replaced, and the apparatus is reassembled and the power restored. It is not necessary to take special precautions to prevent any hazardous atmosphere from entering the light bulb chamber when the glass cap is replaced because the closed chamber after reassembly is "explosion-proof". Thus, the apparatus of this invention is versatile and easily maintained.

Having described the invention what is claimed is:

1. An electrical illuminated sign apparatus for emergency illumination in hazardous atmosphere locations comprising:

(a) a housing comprising a forward compartment, a substantially sealed rear compartment, and a divider wall between them having sealed lighting sockets for receiving a plurality of illuminating lamps on the forward compartment side;

(b) said forward compartment having a substantially opaque forward face with translucent lettering or sign areas; and, (c) said rear compartment having sealed electrical connections to at least two independent power sources.

2. The illuminated sign apparatus of claim 1 wherein at least two of said illuminating lamps are parallel-connected to one power source and at least two other said illuminating lamps are parallel-connected to a second power source.

3. The illuminated sign apparatus of claim 2 wherein one power source is a standard alternating current and the second power source is a direct current.

4. The illuminated sign apparatus of claim 1 wherein each of said sealed lighting sockets comprises: a sealed barrel externally threaded to engage a threaded aperture in said divider wall; a lamp-receiver at the forward end of said barrel and an illuminating lamp connected thereto; electrical wire connected to said lamp-receiver and extending laterally through the interior of the barrel and out of the rear of the barrel; an internally-threaded cylindrical flange at the forward end of said barrel; and, a glass cover externally-threaded to engage said cylindrical flange thereby creating a substantially sealed chamber enclosing said illuminating lamp.

5. The illuminated sign apparatus of claim 4 wherein said glass cover comprises a heavy-duty, shatter-proof glass cap with an outward lip and an externally-threaded metal casing designed to fit snugly over said lip and engage said cylindrical flange.

6. The illuminated sign apparatus of claim 5 wherein said divider wall, said barrel, said cylindrical flange, and said casing are constructed of a strong and highly heat-conducting metal.

7. The illuminated sign apparatus of claim 6 wherein said metal is selected from the group consisting of aluminum and aluminum alloys.

8. The illuminated sign apparatus of claim 1 wherein each of said sealed electrical connections comprises at least one cylindrical, internally-threaded flange and a sealed barrel externally-threaded to engage said flange having electrical wires extending laterally through the interior of said barrel.

9. The illuminated sign apparatus of claim 8 wherein said cylindrical flange and said sealed barrel are constructed of a strong and highly heat-conducting metal.

10. The illuminated sign apparatus of claim 9 wherein said metal is selected from the group consisting of aluminum and aluminum alloys.

11. The illuminated sign apparatus of claim 10 wherein said substantially opaque forward face of said forward compartment is readily removable.

12. In an electrical illuminated sign apparatus for emergency illumination, the improvement which comprises using a two-compartment housing separated by a divider wall which separates the front compartment from the rear explosion-proof compartment, said divider wall having sealed lighting socket means for receiving a plurality of illuminating lamps on the front compartment side and said rear compartment having sealed electrical connection means to at least two independent power sources.

13. In the illuminated sign apparatus of claim 12, the improvement which further comprises having at least two of said illuminating lamps in parallel connection to one power source and at least two other said illuminating lamps in parallel connection to a second power source.

14. The illuminated sign apparatus of claim 12 wherein said sealed lighting socket means comprises: a sealed barrel externally threaded to engage a threaded aperture in said divider wall; lamp-receiving means at the forward end of said barrel and an illuminating lamp connected thereto; electrical wire means connected to said lamp-receiving means and extending laterally through the interior of the barrel and out of the rear of the barrel; an internally-threaded cylindrical flange at the forward end of said barrel; and, glass cover means externally-threaded to engage said cylindrical flange thereby creating a substantially sealed chamber enclosing said illuminating lamp.

15. The illuminated sign apparatus of claim 14 wherein said glass cover means comprises a heavy-duty, shatter-proof glass cap with an outward lip and an externally-threaded metal casing designed to fit snugly over said lip and engage said cylindrical flange.

16. The illuminated sign apparatus of claim 15 wherein said divider wall, said barrel, said cylindrical flange, and said casing are constructed of a strong and highly heat-conducting metal.

17. The illuminated sign apparatus of claim 12 wherein said sealed electrical connection means to said rear compartment comprises at least one cylindrical, internally-threaded flange and a sealed barrel externally-threaded to engage said flange having electrical wire means extending laterally through the interior of said barrel.

18. The illuminated sign apparatus of claim 17 wherein said cylindrical flange and said sealed barrel are constructed of a strong and highly heat-conducting metal.

* * * * *